US006270397B1

(12) United States Patent
Wu

(10) Patent No.: US 6,270,397 B1
(45) Date of Patent: Aug. 7, 2001

(54) CHEMICAL MECHANICAL POLISHING DEVICE WITH A PRESSURE MECHANISM

(75) Inventor: Hsiao Che Wu, Chung-Li (TW)

(73) Assignees: Promos Technologies Inc.; Mosel Vitelic Inc., both of Hsinchu (TW); Siemens AG, Munich (DE)

( * ) Notice: Subject to any disclaimer, the term of this patent is extended or adjusted under 35 U.S.C. 154(b) by 0 days.

(21) Appl. No.: 09/495,225

(22) Filed: Jan. 31, 2000

(51) Int. Cl.[7] ..... B24B 7/00
(52) U.S. Cl. ..... 451/288; 451/165
(58) Field of Search ..... 451/41, 165, 285, 451/287, 288; 156/345, 645.1, 636.1

(56) References Cited

U.S. PATENT DOCUMENTS 5,187,899 * 2/1993 Rhoades ..... 451/165
5,688,364 * 11/1997 Sato ..... 451/165 X
5,993,300 * 11/1999 Hashimoto ..... 451/165

* cited by examiner

*Primary Examiner*—Joseph J. Hail, III
*Assistant Examiner*—Anthony Ojini
(74) *Attorney, Agent, or Firm*—Darby & Darby

(57) ABSTRACT

The present invention provides a CMP device with a pressure-controlling mechanism comprising a rotating polishing plate, a slurry supplying system for supplying slurry, a rotating carrier that holds and rotates a silicon wafer such that the wafer surface is polished against the rotating polishing plate and the slurry during a CMP process, and a pressure-controlling mechanism capable of exerting different pressures to different locations on the wafer in response to different polishing rates corresponding to each of the specified locations. By utilizing the CMP device according to the present invention, the polishing rate and finish quality at different locations of the silicon wafer will be more uniform, which in turn contributes to an improved wafer planarizing effect.

16 Claims, 3 Drawing Sheets

CHEMICAL MECHANICAL POLISHING DEVICE WITH A PRESSURE MECHANISM

BACKGROUND OF THE INVENTION

1. Field of the Invention

The present invention relates to a chemical mechanical polishing (referred to as CMP hereafter) device; more specifically, the invention relates to a CMP device with a pressure-controlling mechanism for planarizing silicon wafers.

2. Description of Related Art

Conventionally, the CMP process has been relied upon heavily for providing a complete planarization process to each of the silicon wafers in the production of ULSI devices. An example of such conventional CMP device is illustrated in FIG. 1A.

The above-mentioned conventional CMP device comprises at least the following components: an automated rotating polishing plate 110 having a rotating plate 100 and a polishing pad 120, wherein the main function of the rotating plate 100 is to support and rotate the polishing pad 120; a slurry supplying system 130 is provided for supplying slurry 150 to a surface of a polishing pad 120; and a rotating carrier 160 having a spindle 180 for holding and rotating a silicon wafer 140 that is to be polished by the polishing pad 120 and slurry 150 during a CMP process.

Furthermore, a conventional CMP device typically comprises a rotating polishing plate 110 and a rotating carrier, each rotating independently while exerting a pressure force P to opposite sides of the wafer. The slurry used in a CMP process is typically comprised of silica or alumina particles dispersed and suspended in a gel-like acidic or basic etching solution of KOH or $NH_4OH$. Then an automated slurry supplying system 130 supplies slurry 150 to the polishing pad 120 in order to maintain a constant and uniform permeation of the slurry 150 on the polishing pad 120.

The mechanisms involved in the CMP process depend heavily on a chemical polishing, wherein the etching solution in the slurry 150 chemically removes or modifies surface particles of a silicon wafer, while a mechanical polishing of the silicon wafer 140 is achieved through the suspended abrasive particles in the slurry 150 and the rotating action of the polishing pad 120. In addition, waste particles produced on the wafer 140 surface during the chemical polishing are also mechanically removed. Therefore, the overall polishing rate for the wafers can be accelerated by increasing either the chemical or the mechanical polishing rate.

It has always been a goal with conventional CMP devices or machines to polish the entire surface of a silicon wafer 140 in a uniform fashion. The contributing factors that directly affect the wafer polishing rate include the intensity and distribution of pressure force exerted to the wafer surface, relative velocities among each point of location on the wafer surface to the rotating polishing plate 110, properties intrinsic to the compositions of the polishing pad and slurry, and complexity of the ULSI circuit layouts formed on the wafer 140.

Shown in FIG. 1B, as the silicon wafer 140 is pressed against the polishing pad 120, the supposedly flat surface of the polishing pad 120 tends to be deformed due to uneven pressures distributed to the surface of the silicon wafer 140; specifically, there are four locations on the surface of the polishing pad 120, namely We, $W_e$, $W_e1$, $W_c$, and $W_{en}$, where the measured contact pressures are the most distinct.

Each of the locations, or referred to as contact locations hereafter, has a ring shape which is concentric to all the other contact locations. In particular, the contact location We represents a location on the polishing pad 120 which is in direct contact with the edge of the silicon wafer 140. $W_e1$, on the other hand, represents a contact location on the polishing pad 120 next to $W_e$ which in not in direct contact with the silicon wafer 140. $W_c$ represents a contact location on the polishing pad 120 which is in direct contact with the center of the silicon wafer 140, and $W_{en}$ represents a contact location on the silicon wafer 140 which is situated between $W_e1$ and $W_c$. Furthermore, since the contact pressure P exerted by the polishing pad 120 to the silicon wafer 140 at the edge location $W_e$ is the greatest and the contact pressure P at the contact location $W_e1$ is the least, an uneven distribution of the contacting pressure is thus unfavorably created as shown in FIG. 1C. This is then a factor for creating instability.

In addition, the mechanical polishing rate increases as the contacting pressure is increased and vice versa, which in turn generates an unstable physical profile $W_s$ of the wafer at the above-mentioned contacting and non-contacting positions as indicated by FIG. 1D. When peaks and troughs appear in the profile $W_s$ of a wafer as a result of an uneven wafer polishing, waste particles tends to be accumulated on the wafer surface at the position corresponding to $W_e1$ while the wafer surface at the position corresponding to $W_e$ tends to be over-polished.

SUMMARY OF THE INVENTION

Accordingly, it is an object of the present invention to provide a CMP device with a pressure-controlling mechanism comprising a rotating polishing plate, a slurry supplying system for supplying slurry to the surface of a polishing pad, a rotating carrier for holding and rotating a silicon wafer which is in constant contact with the slurry and the rotating polishing plate during the CMP process, and a pressure-controlling mechanism for distributing different contact pressures to different locations on the surface of a silicon wafer in response to different polishing rates. By using the device of the present invention, every point of location on the surface of a silicon wafer can be fully planarized in a uniform fashion.

BRIEF DESCRIPTION OF THE DRAWINGS

Other objects, features, and advantages of the present invention will become apparent from the following detailed description of the preferred but non-limiting embodiment. The description is made with reference to the accompanying drawings in which.

DETAILED DESCRIPTION OF THE PREFERRED EMBODIMENT

The CMP process for fully planarizing silicon wafers in a single process stage is relied upon heavily by the semiconductor industries for the production of ULSI devices. Accordingly, it is an object of the present invention to provide a CMP device with a pressure-controlling mechanism, which can improve on the CMP process by producing more uniformly polished silicon wafers.

Figure 2A:
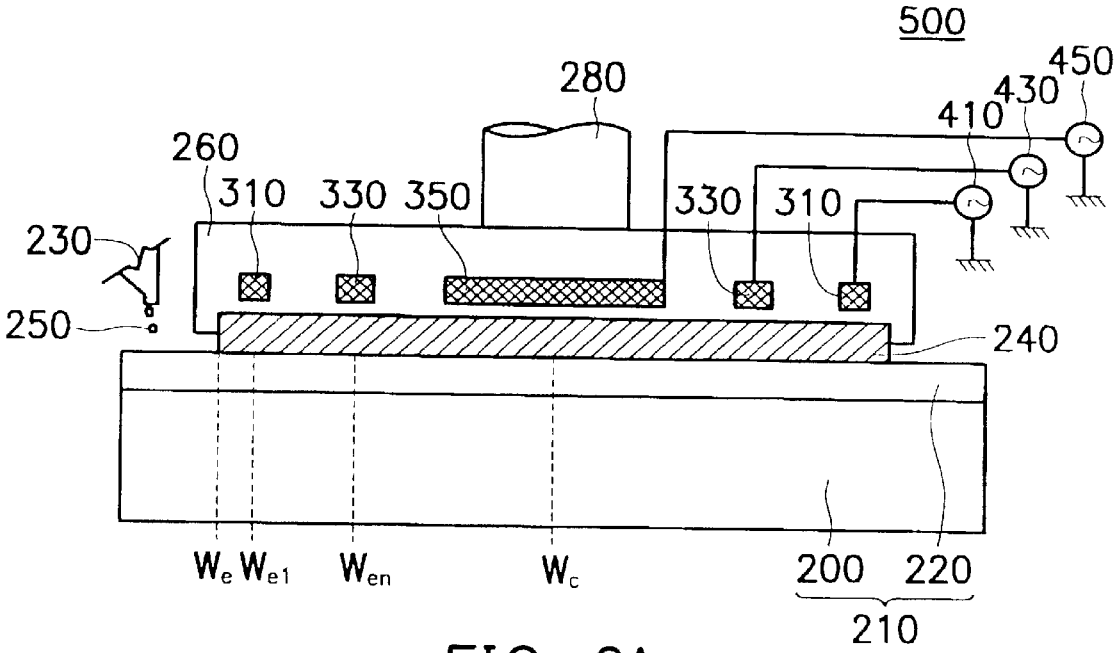
FIG. 2A show a cross-section of a CMP device equipped with a pressure-controlling mechanism of the present invention.
Figure 2B:
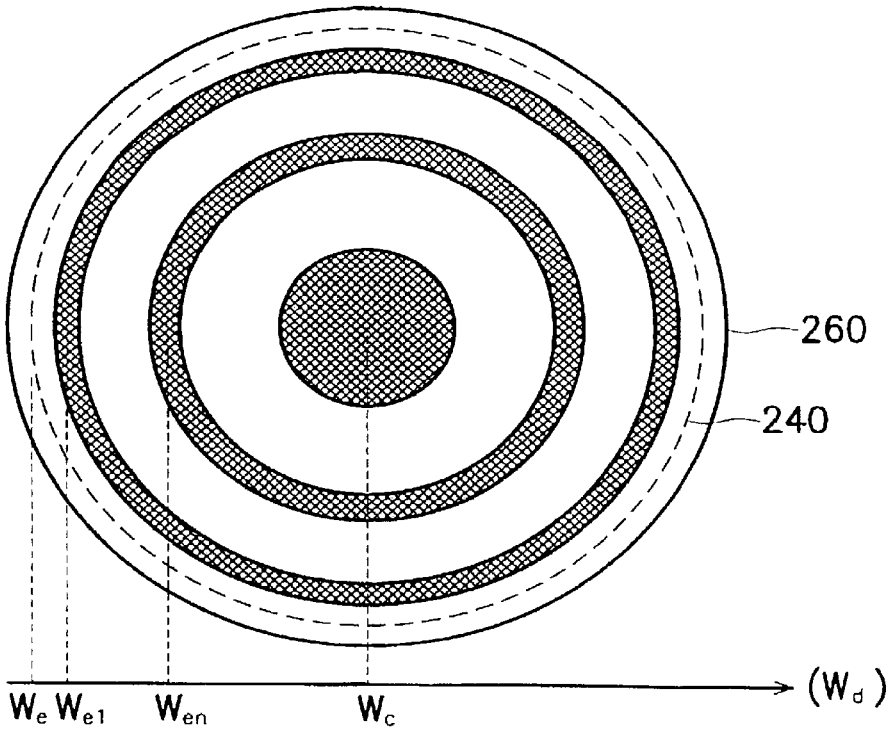
FIG. 2B is a top view of the wafer and rotating carrier shown in FIG. 2A, which illustrates the relationship between the pressure distribution and the contact locations of a silicon wafer.

Referring to FIG. 2A and FIG. 2B, the CMP device according to an embodiment of the present invention includes an automated rotating polishing plate 210 having a rotating plate 200 and a polishing pad 220, wherein the rotating plate 200 is provided for supporting and rotating the polishing pad 220; and a slurry supplying system 230 for supplying slurry 250 to the surface of the polishing pad 220.

The present invention also comprises a rotating carrier 260 with a spindle 280 for holding and rotating a wafer 240 to be polished, which forces the wafer 240 surface into contact with the polishing pad 220 and slurry 250 in order to carry out the CMP process.

Figure 1A:
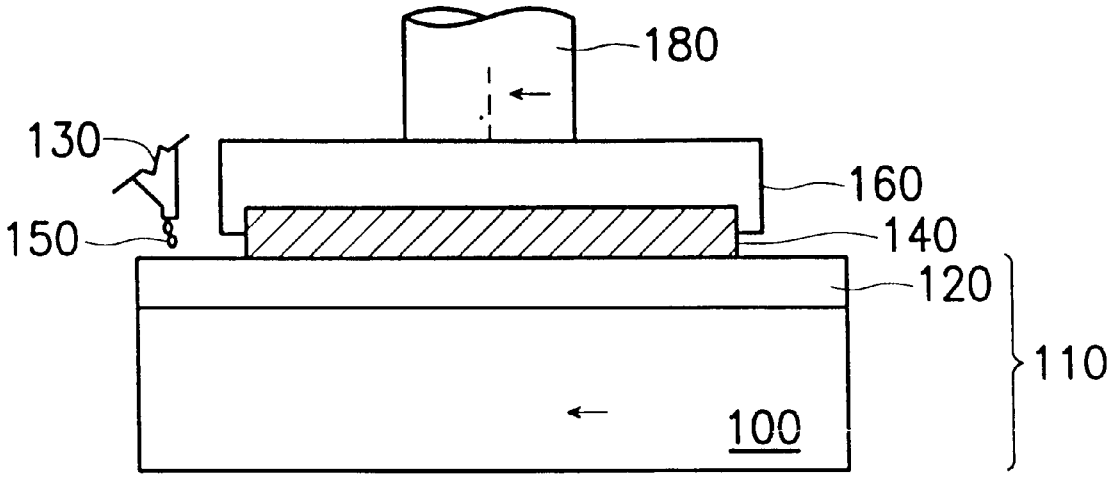
FIG. 1A (PRIOR ART)
FIG. 1A is a cross-sectional view of a conventional CMP device.
Figure 1B:
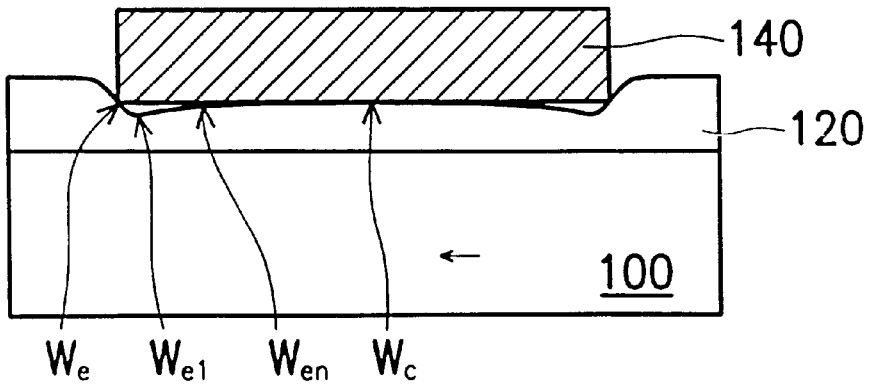
FIG. 1B (PRIOR ART)
FIG. 1B is a cross-sectional view of the polishing pad in FIG. 1A being deformed when it is brought into direct contact with a silicon wafer during the CMP process.
Figure 1C:
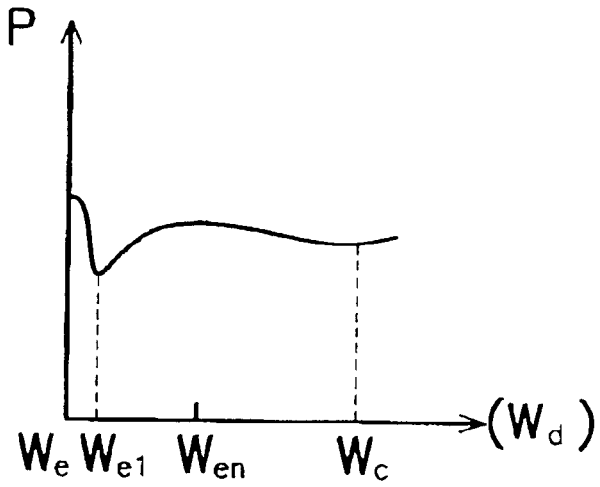
FIG. 1C is a graph showing the relationship between the pressure distribution and the contact locations of a silicon wafer when the silicon wafer of FIG. 1A is in direct contact with the polishing pad.
Figure 1D:
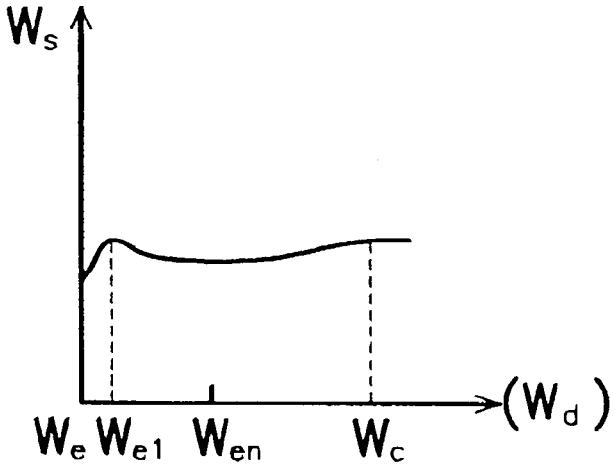
FIG. 1D is a graph showing the relationship between the surface profile and the contact locations of a silicon wafer when the wafer of FIG. 1A is indirect contact with the polishing pad.

Furthermore, the finish quality of the polished wafers is affected directly by the following factors: intensity and distribution of contact pressures on the wafer, relative velocities between the silicon wafer 240 and the rotating polishing plate 210 at each contact location, characteristics of the composing materials of the polishing pad 240 and slurry 250, and layout arrangement of the ULSI circuits formed on the wafer 240. A surface profile $W_s$ of an unevenly polished wafer affected by at least one of the above-mentioned factors is shown in FIGS. 1B, 1C, and 1D, wherein waste particles tend to be accumulated on the trough region of a wafer surface shown corresponding to the contact location $W_e1$ while a peak region of the wafer surface corresponding to the contact location $W_e$ tends to be over-polished.

Therefore, the present invention provides a pressure-controlling mechanism 500, wherein different pressure levels can be distributed to the surface of a silicon wafer at different contact locations having a different corresponding polishing rate.

According to an embodiment of the present invention, the pressure-controlling mechanism 500 can be, for example, an ultrasonic device comprising alternating current sources 410, 430, and 450 each having a typical alternating frequency of about 10 to 100 kHz and a power output of 100 to 500 Watts. Furthermore, vibrating blocks 310, 330, and 350 are each electrically coupled to the alternating current sources 410, 430, and 450, respectively. Typically, the vibrating blocks are composed of piezoelectric materials such as Barium Titanate. The vibrations of the vibrating blocks 310, 330, and 350 are generated by and in accordance with the alternating frequency of a power source, which in turn exert variable pressures to the surface of a wafer in vibrating wave forms. Therefore, each of the vibrating blocks can be positioned at a different contact location on the wafer surface that corresponds with a different polishing rate in order to distribute localized pressure forces with different intensities to the wafer surface at designated contact locations.

For instance, the polishing rate at a location $W_e1$ near the edge of the above-mentioned wafer is lower than the polishing rates at the other locations, which is reflected on the graph displaying the surface profile of the wafer as a peak at the contact location $W_e1$ due to the relatively low polishing rate at the location (see FIG. 1D) The vibrating block 310, composed of a piezoelectric material, is therefore installed on the rotating carrier 260 at a location corresponding to $W_e1$ in order to produce a high-frequency vibration wave generated by the high alternating frequency of the alternating current source 410, which in turn exerts a pressure toward the wafer surface for variably increasing the polishing rate at the designated location.

By the same token, since the polishing rate at the contact location $W_c$ corresponding to the center location of the wafer is also relatively low, the vibrating block 350, also composed of a piezoelectric material, is installed on the rotating carrier 260 at the contact location $W_c$ in order to produce a high-frequency vibration wave generated by the high alternating frequency of the alternating current source 450, which in turn exerts a pressure force toward the wafer surface for variably increasing the polishing rate at the designated location.

In addition, when the polishing rate is curtailed at a designated location such as the location $W_{en}$ shown in FIG. 1B due to a specific geometric arrangement of the circuit layouts, the rotating carrier 260 can also be installed with a vibrating block 330 composed of a piezoelectric material at a location corresponding to $W_{en}$ in order to produce a high-frequency vibration wave generated by the high alternating frequency of the alternating current source 430, which in turn exerts a pressure force toward the wafer surface for variably increasing the polishing rate at the designated location.

Accordingly, the pressure-controlling mechanism 500 distributes different pressure levels to different contact locations on a wafer in a CMP process in response to different polishing rates of the corresponding contact locations in order to achieve a uniformly planarized wafer surface.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A chemical mechanical polishing (CMP) device, comprising:

an automated rotating polishing plate;

a slurry supplying system for supplying slurry to the surface of the automated rotating polishing plate;

a rotating carrier with a spindle for holding and rotating a wafer to be polished, which forces the wafer surface into contact with the automated rotating polishing plate and slurry directly during a CMP process; and a pressure-controlling mechanism for distributing different pressure levels to different contact locations on the surface of the wafer that correspond to different polishing rates.

2. The CMP device as claimed in claim 1, wherein the automated rotating polishing plate comprises a rotating plate and a polishing pad, wherein the rotating plate supports and rotates the polishing pad.

3. The CMP device as claimed in claim 1, wherein the pressure-controlling mechanism comprises:

an alternating current source having an alternating frequency of a specified range; and at least one vibrating block electrically coupled to the above alternating current source for exerting a variable pressure force generated through the alternating frequency to a specified contact location of a wafer surface.

4. The CMP device as claimed in claim 3, wherein the vibrating block is composed of a piezoelectric material.

5. The CMP device as claimed in claim 3, wherein the vibrating block is composed of a Barium Titanate material.

6. The CMP device as claimed in claim 3, wherein the alternating frequency has a range of 10 to 100 kHz.

7. The CMP device as claimed in claim 3, wherein the power output of the alternating current source has a range of 100 to 500 Watts.

8. A chemical mechanical polishing (CMP) device, comprising:

an automated rotating polishing plate;

a slurry supplying system for supplying slurry to the surface of the automated rotating polishing plate;

a rotating carrier with a spindle for holding and rotating a wafer to be polished, which forces the wafer surface into contact with the automated rotating polishing plate and slurry directly during a CMP process;

an alternating current source having an alternating frequency of a specified range; and at least one vibrating block electrically coupled to the above alternating current source for exerting a variable pressure force generated through the alternating frequency to a specified contact location of a wafer surface, wherein different contact locations corresponding to different polishing rates.

9. A chemical mechanical polishing (CMP) device, comprising:

an automated rotating polishing plate;

a slurry supplying system for supplying slurry to the surface of the automated rotating polishing plate;

a rotating carrier with a spindle for holding and rotating a wafer to be polished, which forces the wafer surface into contact with the automated rotating polishing plate and slurry during a CMP process; and a pressure-controlling mechanism for selectively applying a localized pressure to at least one contact location on a portion of the surface of the wafer to elevate the polishing rate at the contact location.

10. The CMP device as claimed in claim 9, wherein the automated rotating polishing plate comprises a rotating plate and a polishing pad, wherein the rotating plate supports and rotates the polishing pad.

11. The CMP device as claimed in claim 9, wherein the pressure-controlling mechanism comprises:

an alternating current source having an alternating frequency of a specified range; and at least a vibrating block electrically coupled to the above alternating current source for exerting a variable pressure force generated through the alternating frequency to a specified contact location of a wafer surface.

12. The CMP device as claimed in claim 11, wherein the vibrating block is composed of a piezoelectric material.

13. The CMP device as claimed in claim 11, wherein the vibrating block is composed of a Barium Titanate material.

14. The CMP device as claimed in claim 11, wherein the alternating frequency has a range of 10 to 100 kHz.

15. The CMP device as claimed in claim 11, wherein the power output of the alternating current source has a range of 100 to 500 Watts.

16. The CMP device as claimed in claim 9, wherein the contact location corresponds to an area of the surface of the wafer having a lower polishing rate absent the localized pressure of the pressure-controlling mechanism.

* * * * *

UNITED STATES PATENT AND TRADEMARK OFFICE

CERTIFICATE OF CORRECTION

PATENT NO. : 6,270,397 B1
DATED : August 7, 2001
INVENTOR(S) : Hsiao Che Wu

It is certified that error appears in the above-identified patent and that said Letters Patent is hereby corrected as shown below:

Title page,
Item [54], Title, change "CHEMICAL MECHANICAL POLISHING DEVICE WITH A PRESSURE MECHANISM" to -- CHEMICAL MECHANICAL POLISHING DEVICE WITH A PRESSURE-CONTROLLING MECHANISM --.

Signed and Sealed this

Second Day of April, 2002

*Attest:*

*Attesting Officer*

JAMES E. ROGAN
*Director of the United States Patent and Trademark Office*